United States Patent [19]

Moore

[11] 4,306,821

[45] Dec. 22, 1981

[54] METHOD AND APPARATUS FOR RESTORING PILING

[76] Inventor: Charles D. Moore, P.O. Box 1842, Houma, La. 70361

[21] Appl. No.: 917,165

[22] Filed: Jun. 20, 1978

[51] Int. Cl.[3] ..... E02D 5/60

[52] U.S. Cl. ..... 405/216; 405/211

[58] Field of Search ..... 405/84, 216, 211; 52/297, 514, 423, 725

[56] References Cited

U.S. PATENT DOCUMENTS

| | | | |
|---|---|---|---|
| 3,321,924 | 5/1967 | Liddell | 405/216 |
| 3,708,146 | 1/1973 | Lamberton | 405/216 |
| 4,019,301 | 4/1977 | Fox | 52/725 |
| 4,023,374 | 5/1977 | Colbert et al. | 52/725 X |
| 4,068,483 | 1/1978 | Papworth | 405/216 |
| 4,114,388 | 9/1978 | Straub | 405/216 |

FOREIGN PATENT DOCUMENTS

| | | | |
|---|---|---|---|
| 1494072 | 12/1977 | United Kingdom | 405/216 |

OTHER PUBLICATIONS

Engineering News-Record, Jun. 20, 1963, p. 121.

*Primary Examiner*—Dennis L. Taylor

[57] ABSTRACT

The system for the restoring and reconditioning structural pile provides an outer form which is attachable to a portion of a piling which has been eroded or corroded and has lost some of its thickness and thus its overall strength. A diameter building filler is placed into an intraform space between the form and the piling, the filler providing a protective and structural coating to that portion of the piling where corrosion or damage has taken place. In the preferred embodiment the filler is a setting material such as a suitable epoxy.

1 Claim, 8 Drawing Figures

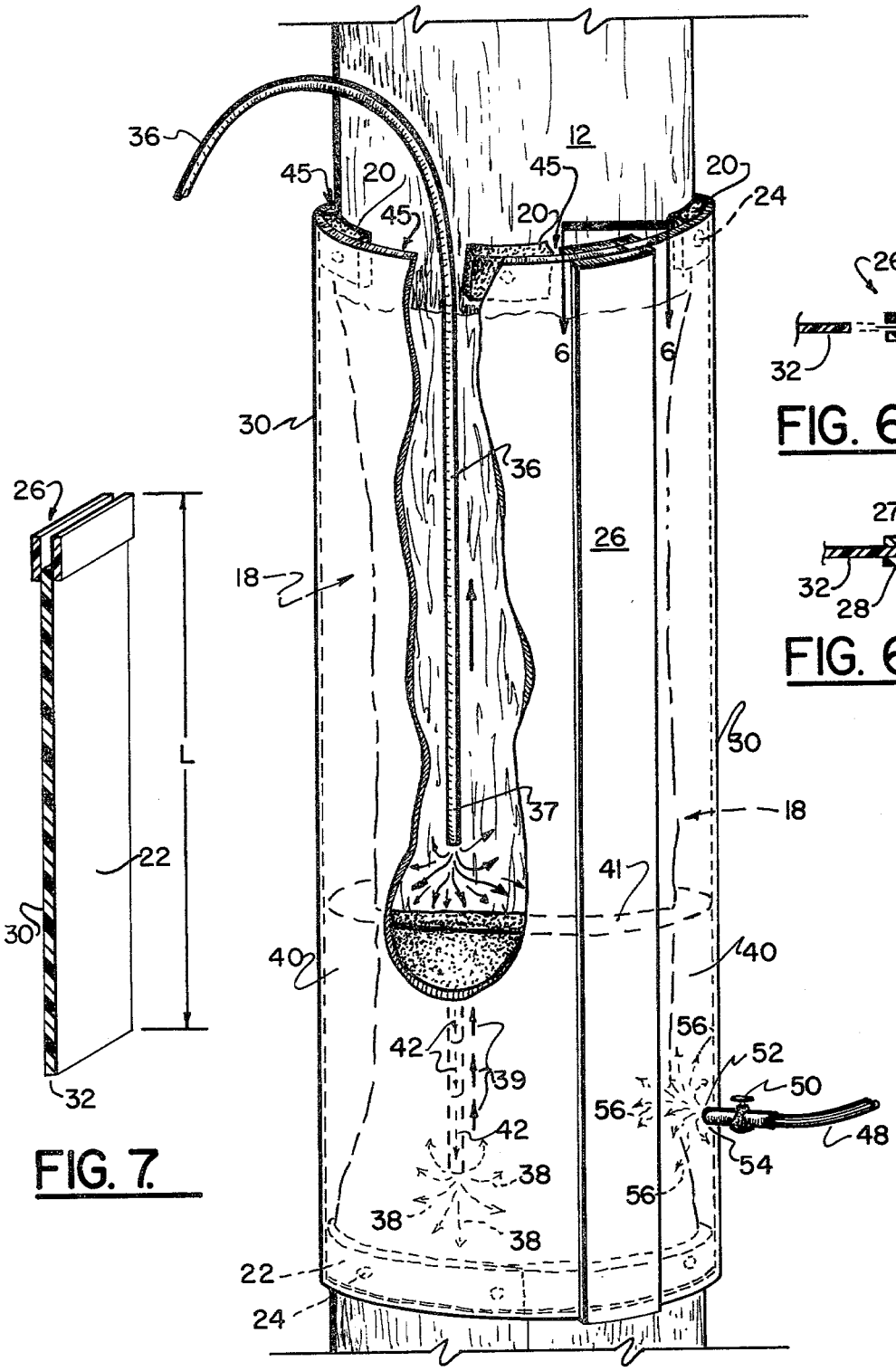
FIG. 5.
FIG. 7.
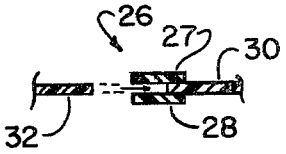
FIG. 6a.
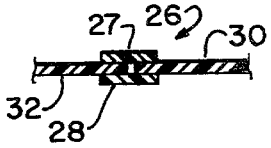
FIG. 6b.

METHOD AND APPARATUS FOR RESTORING PILING

BACKGROUND OF THE INVENTION

1. Field of the Invention

The present invention relates to the reconditioning and restoration of posts and piling, and more particularly relates to a method in apparatus for the reconditioning of marine piling, especially at the water level.

2. General Background and Prior Art

In the marine environment, posts, piling, and like structural members frequently become eroded or corroded especially at the water line area. The area far beneath the water line is usually protected by cathodic protection, while that portion of the pile well above the water line is easily painted for protection and seldom comes in contact with water which can cause corrosion or erosion.

At the water line however, the piling can be attacked by wave action, tidal fluctuations, marine growth, oxidation, and the like. Steel pipes which are used as piling, as well as wooden posts such as creosote posts all suffer extensively from corrosion and/or mechanical erosion in this area adjacent the water surface. Wooden piling and creosote piling can become rotten as they are attacked by worms.

Concrete piling also suffer at the water line, as the water can seep into the pores of the concrete. Air and water in the pores of a concrete piling can cause it to expand and produce cracks due to stress. Once cracks have allowed water to seep into the inner portion of a concrete pile member, the steel or metal reinforcement is exposed and can quickly corrode with the reinforcing steel of the concrete piling loosing much if not all of its tensile strength.

From the above, it can be seen that when corrosion or erosion of such piling becomes severe, the piling itself must be demolished or replaced, or at least structurally reinforced. The repairing and reinforcing of such piling has usually involved the construction of a wall, cofferdam, or like around the piling with the subsequent removal of water to give workmen a dry space in which to work.

The necessity of creating a dry environment around a marine piling is quite costly and can often be impossible in for example severe marine environment such as the North Sea.

Even if some type of protective coating were to be added to a piling member, it must be a coating which is substantially water resistent so that subsequent attack will not rekindle an old problem.

GENERAL DISCUSSION OF THE PRESENT INVENTION

An object of the present invention is to provide a simple and effective method of repairing a partially corroded pipe or pile and protecting it against further corrosion or mechanical erosion.

The invention provides an apparatus which is comprised of an outer circumferential form which is attachable to that portion of the piling which needs to be reconditioned or restored. In the preferred embodiment, the form is a flexible sheet of material which is circumferentially attached about the piling with spaces being provided to hold it off the pile itself, thus providing an intraform space into which a suitable filler is placed. The filler in the preferred embodiment forms a protective and structural coating to that portion of the piling to which the form is attached, which portion of the piling has been corroded, eroded, or otherwise "eaten away". The filler is preferably heavier than water and substantially water impenetrable. The filler in the preferred embodiment is initially a fluid, but eventually sets to form a structural, integral bond with the piling itself.

The form is provided at its lower end portion with a seal which prevents the escape of the filler from the bottom of the form at its connection to the piling itself. The intraform space is filled with the suitable filler, the intraform space being occupied by the filler as is desirable. Since the filler is heavier than water and initially flowable it displaces the water within the intraform space as it is added thereto. From the above it can be seen that the problem of providing a dry environment is solved, since the filter material is initially flowable and is both water impenetrable and heavier than water negating the need for a dry environment for its application. The filler merely enters the intraform space (by pouring for example) and fills it, displacing the sea water upward and out of the intraform space as is desirable (See FIG. 5).

In the preferred embodiment, the filler material is a suitable epoxy which is water impenetrable, and which initially is a pumpable flowable fluid which can be added to the intraform space by means of, for example, a suitable flexible conduit, or hose. The flowable filler flows into all the crevices, holes, gaps, and like corroded and/or eroded imperfections of the pile member as it is added to the intraform space in its initial liquid form. After the liquid filler is added to the intraform space in this manner, it subsequently sets and hardens providing a structural and integral bond with the worn piling, reconditioning it and giving it added protection and structural integrity.

In the method of the present invention, the piling member is first cleaned of extraneous matter, such as marine growth, scum, rust, and the like, with a suitable cleansing unit such as a sand blasting, water blasting, or like apparatus.

The second step in the method of the present invention involves the attachment of a circumferential form about the corroded or damaged section of piling, the form providing a substantially fluid tight envelope about the corroded section of the piling. A suitable spacer which can be, for example, a strip of sealing material is placed between the pile and the outer form member. At the lowermost portion of the form, the spacer is continuous and provides a bottom seal creating a dam for the prevention of downward travel of the filler material from the form and the corroded area. At the upper portion of the form, spaced seal members are provided so that filler material can be added. The form is thus spaced a distance from the piling, providing an intraform space between the pile and the outer form. Into this space will be added a suitable filler material which is at first a pumpable fluid, and thereafter sets to form a structural integral connection with the damaged pile. The form can be held in a secured type position about the pile, with the inner filler being likewise supported there within by a plurality of tensile fastener or straps.

If desired, the form can be removed after the epoxy or like filler has hardened, although the removal of the form is not necessary.

BRIEF DESCRIPTION OF THE DRAWINGS

For a further understanding of the nature and objects of the present invention, reference should be had to the following detailed description, taken in conjunction with the accompanying drawings, in which like parts are given like reference numerals and wherein:

FIG. 5 is a perspective view of the preferred embodiment of the apparatus of the present invention, and further illustrates the method of the present invention, with filler being added to the intraform space between the outer form and piling member;

FIGS. 6A and 6B are sectional views taken along lines 6—6 of FIG. 5, the said views illustrating the tongue and groove connection utilized with the form portion of the preferred embodiment of the apparatus of the present invention; and FIG. 7 is a sectional view of the form and lower seal portions of the preferred embodiment of the apparatus of the present invention.

DETAILED DESCRIPTION OF PREFERRED EMBODIMENT

FIGS. 1–5 illustrate broadly the method of the present invention used on a pile 12 mounted in a marine environment to the ocean floor 16.

Figure 3:
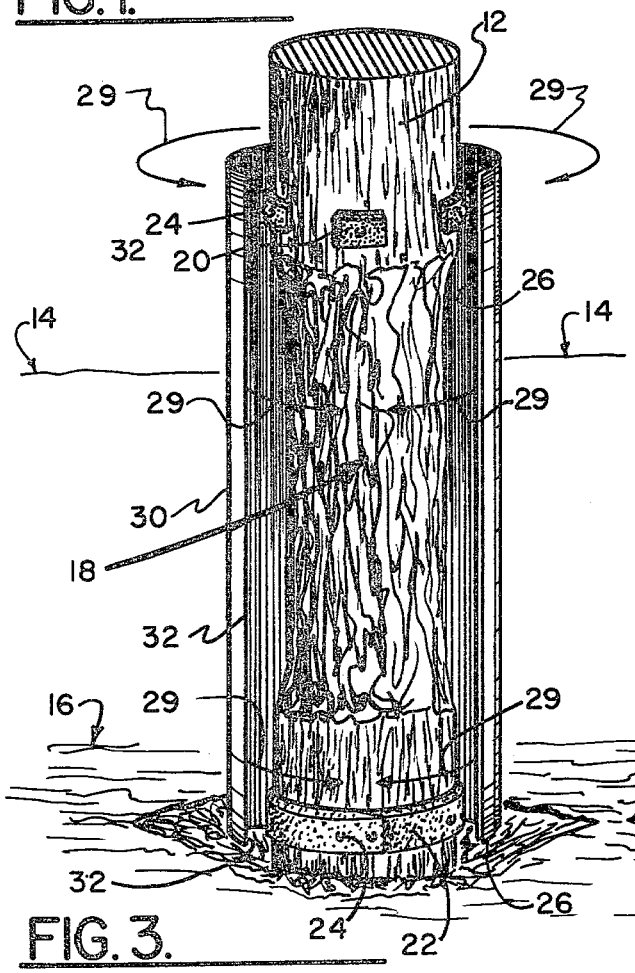
FIG. 3 illustrates the third step of the method of the present invention, and provides a perspective view of the preferred embodiment of the apparatus of the present invention being applied to a typical damaged pile member.
Figure 4:
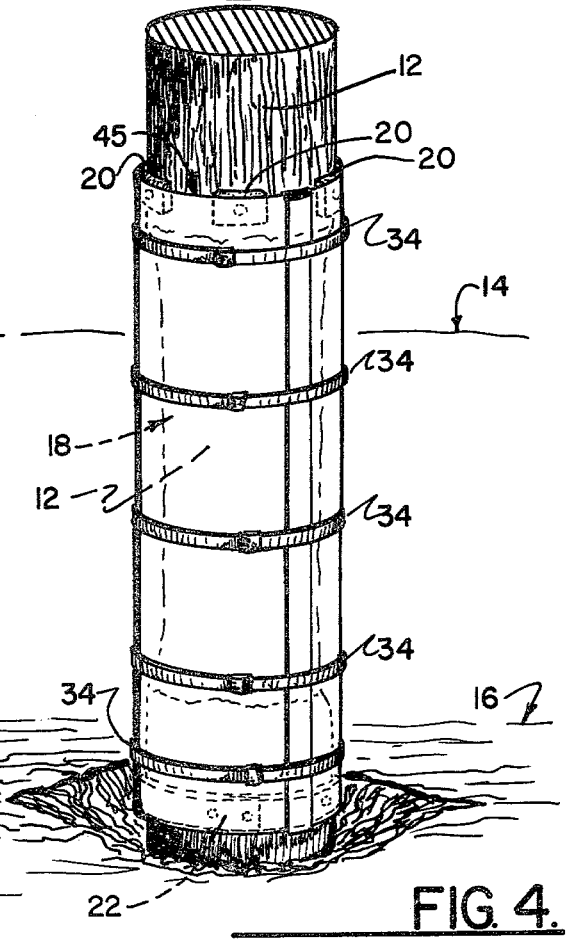
FIG. 4 is a perspective view of the preferred embodiment of the embodiment of the apparatus of the present invention in position around a damaged pile.

FIGS. 3, 4 & 5, illustrate broadly the preferred embodiment of the apparatus of the present invention, while FIGS. 6, 6A & 7, illustrate structural connections of the outer form.

Figure 1:
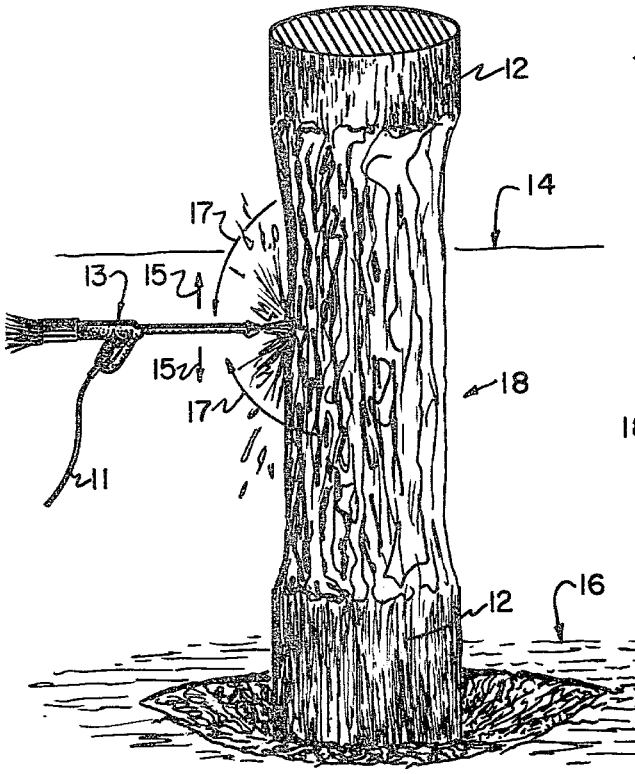
FIG. 1 is a perspective view of the first step of the method of the present invention.

In FIG. 1, there can be seen a typical pile 12 which in FIG. 1 is being cleaned by means of a suitable cleaning device such as a sand blasting rig 13. Pile 12 could be a timber pile such as a creosote timber pile, steel pile, or like structural support member as is known and used in the structural engineering and construction art. It should be understood that any suitable mechanical means of cleaning pile 12 could be employed, such as sand blasting, water blasting, scraping, and the like.

The pile 12 illustrated in FIG. 1 is shown in a marine environment, with the water line 14 being schematically illustrated. Note further in FIG. 1 that a corroded, eroded, or otherwise damaged recess 18 is shown. This circumferential eroded area 18 is the problem to which the present invention is addressed.

Note in FIG. 1 that arrows 15 indicate the vertical movement of the cleaning apparatus or sand blasting rig 13, while curved arrow 17 illustrate its circumferential movement. Arrows 15, 17, illustrate that a suitable sand blasting rig or a like cleaning apparatus will be utilized to clean the entire circumferential eroded area 18 of extraneous barnicles, marine growth, corrosion, rust, and the like, to provide a good surface to which a suitable structural bond can be made with the filler portion of the present invention as we will discuss more fully hereinafter.

Sand blasting rig 13 can be supplied through line 11 with a suitable supply of blasting materials, such as sand or water as is known.

Figure 2:
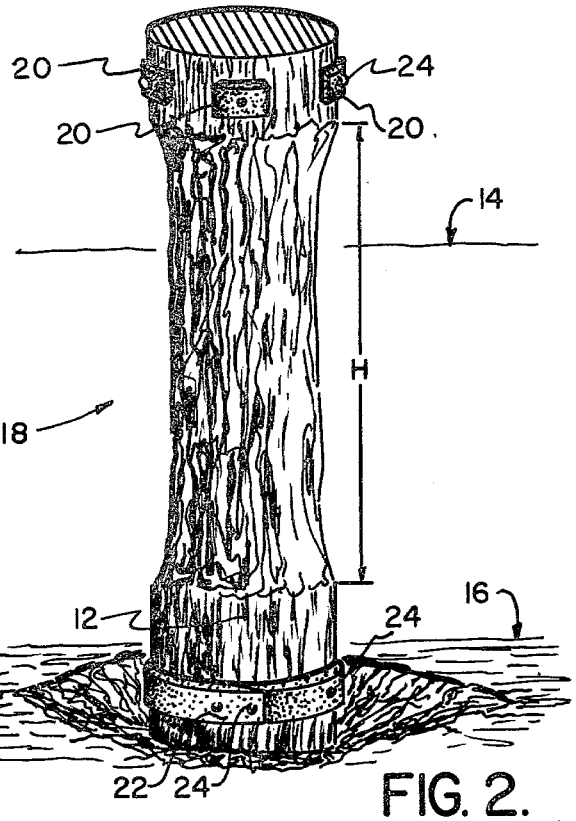
FIG. 2 is a perspective view of the second step of the method of the present invention.

In FIG. 2, there can be seen the placement of a lower strap seal 22 and a plurality of upper strap seals 20. Note that lower strap seal 22 is continuous circumferentially about pile 12. Lower strap seal 22 could be attached to piling 12 by any suitable means as fastener 24. Suitable fasteners such as, nails, bolts, screws, or the like could be employed. Further, lower seal 22 and upper seals 20 could be applied directly to form 30 by glue or like means if desirable an "MEK" (methyl ethyl keytone) glue would be suitable.

Note that upper and lower seals 20, 22 are placed above and below circumferentially eroded area 18, which area is indicated to be of a height "H" of piling 12 in FIG. 2.

In FIG. 3, there can be seen a form 30 which is a sheet of flexible material and is circumferentially attached about piling 12 and adhered in a sealable fashion to seals 20, 24. Note that seal 24 is continuous in its lowermost position. When form 30 is fully attached to pile 12, its attachment against lower seal 24 will form a lowermost "dam", which will prevent the lower or downward escape of filler from the space created between piling 12 and form 30, which could be called an "intraform" space. Each seal 20, 22 has a certain thickness which will hold form 30 in a spaced orientation from pile 12. This creates an intraform space to which a suitable filler will be added as we will described more fully hereinafter. By providing such a spacing of form 30 from pile 12, added thickness at the corroded area 18 can be achieved. Thus, the pile will be in fact, as strong as, if not more strong than it was prior to the repair and reconditioning as is taught by the present invention.

In FIG. 3, arrows 29 indicate schematically the circumferential attachment of form 30 to pile 12.

The final connection of form 30 about piling 12 is perfected when the tongue and groove connection 26 is made. In FIG. 3, there can be seen a leading edge 32 portion of form 30 which interlocks with the tongue and groove 26 portion thereof. (See in detail—FIGS. 6A and 6B).

In FIG. 4, the tongue and groove connection 26 of form 30 has been completed. A plurality of tensile strap fasteners is seen which hold the form 30 about pile 12 and against seal members 20, 22, as is desirable. Tensile fasteners 34 would be set at a fixed diameter so as to prevent the bulging or expansion of form 30 after the filler material is added. Straps 34 could be subsequently added to form 30 as filler is pumped into the intraform space as will be described more fully hereinafter with respect to FIG. 5.

Note in FIGS. 6 and 6A the attachment of form 30 about pile 12 by means of the tongue and groove 26 connection. The form 30 provides two end portions. One end portion 32 provides a male connection, the other end portion 27, 28 consists of a pair of flaps 27, 28, which are attached by gluing, for example, to form 30. The connection of end portion 32 of form 30 to the tongue and groove 26 connection completes a substantially fluid tight seal of form 30 about piling 12 as is desirable. This completed connection is illustrated in FIGS. 6A and 6B, as well as FIG. 5.

In FIG. 2, upper and lower seals 20, 22 are shown as first attached to piling 12.

In FIG. 7, a form 30 of length "L" is shown. It should be understood that lower seal 22 can be utilized to "measure" the circumference of pile 12 at the point of attachment of seal 22 thereto. Thus, when so attached and used to measure pile 12, seal 22 likewise could be used to gauge the necessary length "L" required for form 30. With such a measuring by lower seal 22, it could be glued directly to form 30 by using a suitable glue prior to the attachment of form 30 to pile 12. Upper seals 20 could likewise be glued to form 30 if desired.

In FIG. 5, there can be seen a conduit 36 or like fluid conveying tube which is used to add a suitable filler 41 such as epoxy to the intraform space (that space between the pile 12 and form 30). The intraform space is shown in FIG. 5 to contain the lower tip portion 37 of conduit 36. Arrows 38 schematically illustrate the flow of epoxy or like filler 41 from conduit 36 into the intraform space.

Note that upper seal 20 is comprised of a plurality of seal members 20 which leaves a plurality of gaps 45 between the pile 12 and form 30. This gap 45 provides a space through which conduit 36 can be placed so that it can enter the intraform space and fill the space with epoxy or like filler 40.

If desirable, conduit 36 can be withdrawn (See arrow 39, FIG. 5) as the level 41 of epoxy or like filler 40 rises.

A suitable epoxy or like filler 40 would be utilized which would be heavier than water. Thus, as the filler 40 is added to the intraform space, the water would be displaced upwardly spilling out through gaps 45 and expelled to the outside of form 30. Further, a suitable epoxy or like filler 40 would be selected which would be water impenetrable, negating the chance for the mixture of water and filler 40.

From the above, it can be seen that a "dry" environment is not necessary for the practice of the present invention. The present invention provides a method for reconditioning piles which can be performed at the water line or in a marine environment with no extra construction or cofferdam required. The method of the present invention works substantially equally well in both "wet" and "dry" environments.

Indeed, the present invention could be practiced by two individuals by one overseeing a pump to feed epoxy or like filler 40 through conduit 36 to the intraform sspace. A second individual such as a diver (in a marine installation) could oversee the proper placement of the tip portion of conduit 36 during the actual filling operation.

An alternative form of attachment of conduit 36 is seen at the lowermost portion of FIG. 5. There is provided a conduit 48 having a valve 50 which attaches at its distal end portion 52 to an opening 54 in form 30. Thus, a continuous injection of filler material 40 could be made through conduit 48, valve 50, into the intraform space as is indicated schematically by arrows 56 in FIG. 5. With such an apparatus, the valve could be merely closed after the filling operation and if desired, removed once the epoxy or like setting filler 40 had hardened somewhat.

Form 30 could be manufactured of any suitable preferably flexible plastic material such as "ABS" plastic, "PVC" plastic, or fiberglass. Upper and lower seal members 20, 22 could be provided of a resilient material such as a fairly stiff foam or rubber.

A suitable resilient material such as that sold by Union Carbide Co. under the name "Evazote" would suffice as seal members 20, 22.

A plurality of spacer blocks as is shown in seal 20 could be positioned wherever desirable within the intraform space to prevent the form 30 from touching pipe 12. Such blocks could be provided of a resilient material such as Evazote or any other type material to which the filler 40 could bond.

Filler 40 would preferably be a thermo-plastic type material such as epoxy. A suitable epoxy material would be comprised for example of forty to sixty percent by weight of (40%–60%) Shell Oil Companies resin No. 828 and forty to sixty percent by weight (40%–60%) of Pacific Anchor Chemical Companies hardener "SUR-WET-R".

In order to aide the pumping of these epoxy materials prior to their filling into the intraform space as illustrated in FIG. 5, the epoxy or like filler 40 could be warmed sufficiently, with a temperature of ninety degrees Fahrenheit (90° F.) being exemplary.

If the piling member were of wood or concrete, a sand or like granular solid could be added to the thermo-plastic filler material 40. The sand occupies some volume, with the more expensive epoxy lasting longer.

When the pile 12 is of metal, the quantity of Ciba Geigy No. 508 resin, being less than 10% by weight of the epoxy material or filler 40 is added to the filler 40. Thus, such an epoxy material or filler 40 would be comprised as follows: 50% by weight of SUR-WET-R hardener, 45–49.5% by weight of Shell's No. 828 resin, and 0.5–5% by weight of Ciba Geigy's 508 resin.

Alternatively, the epoxy material 40 could comprise approximately 65% by weight of Ciba Geigy's resin No. 502 or 507 and approximately 35% by weight of a mixture of Ciba Geigy's hardener No. 830 and 850.

In a second aspect the present invention broadly consists in a method of positioning a form, comprising a sleeve or jacket around a pipe or pile, injecting epoxy material into the form, the epoxy material comprising a mixture of 40 to 60% by weight of Shell Oil Company's No. 828 resin and 40 to 60% by weight of Pacific Anchor Chemical Company's hardener SUR-WET-R, and allowing the epoxy material to set.

Preferably, the resin comprises 50% by weight of Shell Oil Company's No. 828 and 50% by weight of Pacific Anchor Company's SUR-WET-R.

Alternatively, the resin comprises 45 to 49.5% by weight of Shell resin No. 828, 50% by weight of SUR-WET-R and Ciba Geigy resin No. 508.

The form 30 preferably is made of ABS plastics, coated with an acrylic paint if desired, although other plastics materials such as PVC may be suitable as may also fiberglass. It is important that the material will be such as not to deteriorate or crack when it is exposed to the marine environment. Around the top and bottom edge of the form there is a strip of resilient material to seal off the space within the form. The resilient material may be foam plastics and is preferably the material sold by Union Carbide Company under the name EVA-ZOTE. The sealing strip at the top end has one or more gaps in it so that material can be injected into the form through the gap and so that any water enclosed within the form can be expelled through the gap.

The plastics form preferably has a groove formation along each longitudinal side so that when the form is wrapped around the pile or pipe and these edges are brought together to close the form the two grooves can slot into each other to provide an effective seal. (See FIGS. 6A and 6B.) Each groove is in the form of a double flap of material along the edge of the sheet so that in cross-section the edge of the sheet has a "Y" formation. One arm of each "Y" can then fit into the space between the arms of the other "Y" and the flaps are laid together to provide the seal. However, instead of providing a tongue and groove seal, it is possible simply to wrap a flexible sheet around the pipe or pile a couple of times and secure it so that it neither leaks nor collapses onto the pipe or pile.

Reinforcing tensile fastener bands 36 typically of stainless steel are positioned around the form along the length of it and are secured tightly so that the seal along the form cannot comp apart. (See FIG. 4.) They are, however, not so tight that the form is either buckled in or touching against the pipe or pile itself.

If the pipe or pile is not vertical it may be necessary to have spacing blocks within the form so that the form does not collapse onto the pipe or pile. These blocks may also be desired even when the pipe or pile is vertical. They may be small pieces of EVAZOTE form, or they may be blocks of resin material with wooden piling, nails or bolts could be driven into the pile leaving a small length of each nail or bolt exposed to act as a "spacer". A plurality of such nails or bolts substantially equally spaced over the eroded area would be desirable.

Once this material is set, it is hard and strong and adheres firmly to the wood or concrete and also to the ABS form. The stainless steel fastener bands 36 may be removed if desired but this is not necessary. Thus all the corroded material which has been removed from the pile has been replaced by the epoxy resin which is strong to give a reinforcing strength to the pile so that it is now stronger than it was when new and also provides a protective surface at the water level of the pile which will not be corroded by water and not easily corroded by wave action.

If the method is being applied to a steel pile or pipe then it is necessary that the epoxy be slightly flexible once set so that it will not come away from the steel when the steel flexes or expands and contracts with variations in temperature. Thus, instead of 50% by weight of No. 828 resin of the Shell Chemical Company, a resin mixture of 45% by weight of Shell's No. 828 resin and 5% by weight of Ciba Geigy's No. 508 Resin is used. These quantities can be varied so that the percentage of the Ciba Geigy resin can vary from 0.5 to 10% by weight. However, once the proportion of the Ciba Geigy resin exceeds 10%, then the final epoxy becomes too soft, and also subject to water corrosion. The ratio of hardener to resin or resin mixture is preferably 50/50 but may vary between 40/60 and 60/40.

The materials are preferably warmed to 90° F. before mixing. If they are not, then bubbles may form in the resin and the material is not as strong. However, the result can still be quite satisfactory. The epoxy material comprising 50% by weight of Shell's No. 828 resin and 50% by weight of Pacific Anchor Chemical's SUR-WET-R hardener, is three to five times stronger than a typical concrete mixture. For example, concrete is typically of 3000–5000 PSI compressive strengths, whereas the epoxy material has a compressive strength of 10,000–15,000 PSI. The addition of the Ciba Geigy resin required for metal pipes and piles does not make the resin material weaker but not so weak that it does not still provide reinforcing strength for steel pipe or pile.

This epoxy material also bonds very securely to a surface which has been immersed in fresh or salt water. The epoxy is water resistant so that water which is adhering to the surface of the piles or pipes is repelled by the epoxy and the epoxy grips firmly to the surface. It also bonds reasonably securely to the ASB plastics of the form, especially if the epoxy is warm as it is injected into the form. It has been found that fresh water can be pumped into the intraform space in a salt water environment, as the resin bonds somewhat better (to metal piling especially) in the fresh water environment.

An alternative epoxy material consists of approximately 65% by weight of Ciba Geigy's resin 502 or 507 and approximately 35% by weight of a mixture of Ciba Geigy hardeners Nos. 830 and 850. The mixture of hardeners preferably comprises equal quantities of each hardener, but this ratio may be varied. It is possible to use only one of the hardeners with none of the other hardener mixed into it. The Ciba Geigy resin 502 will give a stronger epoxy material than the resin 507 will, but resin 507 is less viscous and easier to handle and will give a satisfactory result.

This material bonds well, although not as well as the Shell resin mixture, but it is stronger. It is good for use on wooden and concrete piles and quite satisfactory for metal ones.

The process of injecting the epoxy material into a form to strengthen a pipe or pile need not be restricted to the water line. It can be done to any post or pipe or pile above or below the water surface and may, for example, be applied to telegraph poles also. Also, the method need not be restricted to the repair and rehabilitation of corroded posts, pipes and piles but it may also be used to provide a protective sheathing to a new or substantially uncorroded post, pipe or pile to prevent any corrosion which might affect it in the future.

References in this specification to materials by their trade references should be construed as including the equivalent material when made or sold under any other name.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. A method of reconditioning a structural pile in a marine enviornment at the splash zone comprising the steps of:

a. a water-blasting the surface of the pile in the splash zone area;

b. attaching upper and lower circumferential spacers to the piling above and below the section of the pile to be reconditioned respectively;

c. measuring a sheet of form material to attach to the spacers with the sheet of form material having a length substantially equal to the distance between the spacers and a circumference substantially equal to the circumference of the spacers;

d. securing the form material to the piling at the upper and lower spacers forming an intraform space between the form and the surface of the piling to be reconditioned;

e. placing a conduit into communication with the intraform space;

f. pumping an epoxy fluid into the intraform space through the placed conduit;

g. allowing the epoxy fluid to set.

* * * * *